United States Patent [19]

Heywood et al.

[11] 4,081,710

[45] Mar. 28, 1978

[54] PLATINUM-COATED IGNITERS

[75] Inventors: Alan Edward Heywood; Robert Michael Hutchings, both of London, England

[73] Assignee: Johnson, Matthey & Co., Limited, London, England

[21] Appl. No.: 703,656

[22] Filed: Jul. 8, 1976

[30] Foreign Application Priority Data

Jul. 8, 1975 United Kingdom ..... 28703/75

[51] Int. Cl.[2] ..... H01T 13/20

[52] U.S. Cl. ..... 313/141; 75/170; 123/169 EL; 148/32

[58] Field of Search ..... 75/170; 123/169 EL; 148/32; 313/141

[56] References Cited

U.S. PATENT DOCUMENTS

| | | | |
|---|---|---|---|
| 3,753,795 | 8/1973 | Weber | 75/170 |
| 3,898,081 | 8/1975 | Kukhar | 148/132 |

*Primary Examiner*—Leland A. Sebastian

*Attorney, Agent, or Firm*—Cushman, Darby & Cushman

[57] ABSTRACT

This specification describes an igniter, particularly for gas turbine engines, and comprising two or more electrodes separated by a body of insulating or semi-conducting material and having exposed working surfaces between which sparks may pass, at least part of the working surface or surfaces of at least one of the electrodes comprising a host material in which Co or Ni predominates alloyed or compounded with one or more additional metals selected from the group consisting of Ru, Rh, Pd, Ir, Pt, Ag and Au. Preferably, the additional metal is platinum which is present in an amount of 1 to 20 wt.% of the total metal content.

24 Claims, 3 Drawing Figures

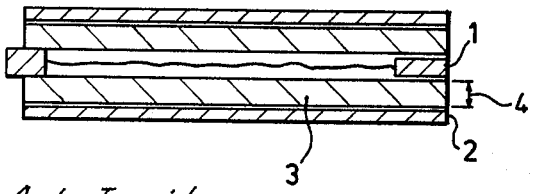
Prior Art Igniter
FIG.1.
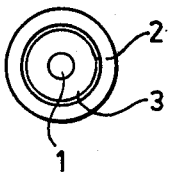
FIG.1A
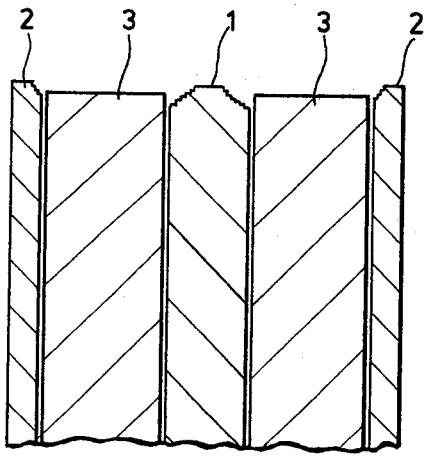
FIG.2. Prior Art Igniter After Failure

PLATINUM-COATED IGNITERS

This invention relates to igniters for igniting combustible mixtures of gases and vapours. More particularly, it relates to an improved form of igniter, and especially of the electrodes therefor, of the type which is commonly used in gas turbines and jet engines.

In the following, an igniter for igniting combustible mixtures of gases and vapours will, when the context requires it, be referred to as "an igniter of the type described."

A typical igniter for a jet engine is depicted in cross-section and end elevation in the attached FIG. 1 and FIG. 1A, respectively. Here a central electrode 1 is surrounded by an insulator 3 which is, in turn, contained within the main body 2 of the igniter. This main body 2 also acts as the outer electrode. The space 4 represents the spark gap between the electrodes.

An igniter of the type shown in FIG. 1 will generally tend to fail after an aggregate period of use at high temperatures of about 50 hours. Failure is generally due, at least in part, to erosion and/or corrosion of the electrode surfaces and/or to the cracking of the insulator separating the electrodes. The appearance of such an igniter after failure is shown diagrammatically in cross-section in FIG. 2, although the cracking of the insulator is not indicated.

Electrode erosion and/or corrosion inhibits proper sparking across the spark gap between the central and outer electrodes by increasing the voltage required for sparking whilst the cracking of the insulator may result in parts thereof entering and damaging the engine.

Electrode erosion is due to normal spark erosion processes and electrode corrosion to the exposure of the electrode surfaces in the engine to hot gases containing, for example, oxidising and sulphur-containing components. The cracking of the insulator may be due in part to the formation of a layer of corrosion products on the surfaces of the igniter assembly adjacent to the insulator so that the insulator is subjected to compressive forces. In part it may also be due to the repeated thermal cycling of the insulator, firstly as the sparks track across its surface and secondly as the combustible mixture of gases is thereby ignited.

Military aircraft tend to use their igniters continuously because of the very real danger of engine "flame-out" due to turbulence at the air intakes during violent manoeuvres. Helicopters and VTOL aircraft when hovering, and when climbing and descending vertically, also need to use their igniters continuously because engine flame-out under these conditions will cause the aircraft to crash. Similarly, many civil aircraft now also use their igniters continuously so that there is an increasing need for igniters which will successfully withstand the arduous operating requirements to which they are nowadays likely to be subject. In fact, many aircraft are at present often grounded when they could otherwise be flying simply because they are compelled to wait for igniters to be changed.

Furthermore, as engines are progressively uprated their operating temperatures are made higher and higher and this results in a progressively shorter working life for those igniters which are currently in service.

According to the present invention, an igniter of the type described comprises two or more electrodes separated by a body of insulating or semi-conducting material and having exposed working surfaces between which sparks may pass, at least part of the working surface or surfaces of one or more electrodes comprising a host material in which Co or Ni predominates alloyed or compounded with one or more additional metals selected from the group consisting of Ru, Rh, Pd, Ir, Pt, Ag and Au.

If desired, at least a part of the working surface of an electrode may be made from a superalloy which also contains one or more additional metals selected from the group consisting of Ru, Rh, Pd, Ir, Pt, Ag and Au. Suitable alloys are described in copending U.S. application Ser. No. 593,250. In this specification, the term "superalloy" is used to include complex nickel- or cobalt-based alloys with additions of such metals as chromium, tungsten, molybdenum, titanium, aluminium and iron.

Preferably, the additional metals Ru, Rh, Pd, Ir, Pt, Ag and Au referred to above constitute from a trace to 20 wt.% (and preferably a trace to 10 wt.%) of the total metal content and are introduced into the body of the electrode(s) concerned by diffusion from a contiguous layer or zone of the required alloying metal or metals.

Apart from impurities, we have found that the undermentioned alloys are particularly suitable for use in the manufacture of at least the exposed surface of an igniter electrode. Further details of the manufacture, physical and metallurgical characteristics of the alloys are given in said co-pending U.S. application Ser. No. 593,250.

TABLE OF ALLOYS

1. An alloy comprising 20 wt.% Cr, 0.4 wt.% Ti, 0.1 wt.% Mn, 0.7 wt.% Si, 0.01 wt.% C and balance nickel in which from a trace to wt.% of the nickel content is replaced by one or more of the additional metals, Ru, Rh, Pd, Ir, Pt, Ag and Au.
2. An alloy comprising 9.0 wt.% Cr, 10 wt.% Co, 12 wt.% W, 1.0 wt.% Nb, 5.0 wt.% Al, 2.0 wt.% Ti, 0.15 wt.% C, 0.015 wt.% B, 0.05 wt.% Zr and balance nickel, in which from a trace to 20 wt.% of the nickel is replaced by one or more of the said additional metals.
3. The alloys identified as 1 and 2 above modified in that Pt is present in an amount from a trace to 10 wt.% of the total metal content.
4. An alloy comprising 40 to 98 wt.% nickel, a trace to 30 wt.% chromium and from a trace to 15 wt.% of one or more of the said additional metals.
5. An alloy comprising 54 to 78 wt.% Ni, 13 to 25 wt.% Cr and 5 to 15 wt.% of one or more of the said additional metals.
6. An alloy containing at least 40 wt.% Ni and from a trace to the percentage specified of any one or more of the following components:

| | | |
|---|---|---|
| cobalt | 25 | wt.% |
| titanium | 6 | wt.% |
| aluminium | 7 | wt.% |
| tungsten | 20 | wt.% |
| molybdenum | 20 | wt.% |
| hafnium | 2 | wt.% |
| manganese | 2 | wt.% |
| silicon | 1.5 | wt.% |
| vanadium | 2.0 | wt.% |
| niobium | 5 | wt.% |
| boron | 0.15 | wt.% |
| carbon | 0.05 | wt.% |
| tantalum | 10 | wt.% |
| zirconium | 3 | wt.% |
| iron | 20 | wt.% |
| thorium/rare earth metals or | | |

-continued

| | | |
|---|---|---|
| oxides thereof | 3 | wt.% |

7. An alloy comprising not less than 40 wt.% Co, a trace up to 30 wt.% chromium and from a trace to 15 wt.% of one or more of the said additional metals.
8. An alloy comprising not less than 40 wt.% Co, 13 to 25 wt.% chromium, and from 5 to 15 wt.% of one or more of the said additional metals.
9. An alloy containing at least 40 wt.% cobalt and from a trace to the percentage specified of any one or more of the following components:

| | | |
|---|---|---|
| nickel | 25 | wt.% |
| titanium | 2 | wt.% |
| aluminium | 5 | wt.% |
| tungsten | 30 | wt.% |
| molybdenum | 5 | wt.% |
| iron | 5 | wt.% |
| tantalum | 10 | wt.% |
| niobium | 5 | wt.% |
| manganese | 2 | wt.% |
| silicon | 1 | wt.% |
| carbon | 1 | wt.% |
| boron | 0.05 | wt.% |
| zirconium | 1.5 | wt.% |
| rhenium | 3 | wt.% |
| thorium/rare earth metals or oxides thereof | 3 | wt.%. |

The present invention also includes an igniter having at least a part of the working surface of an electrode made from a dispersion-strengthened platinum group metal or platinum group metal alloy such as Rh/Pt alloy dispersion strengthened with zirconia; or thoriated tungsten platinum; or a cermet; or a composite material containing one or more additional metals selected from the group consisting of Ru, Rh, Pd, Ir, Pt, Ag and Au and one or more base metals or compounds thereof, and consisting typically of a skeleton of sintered platinum group metal particles into which is infiltrated a metal or alloy such as a Cu/Ni alloy; or of an alloy, such as Ag/Pt alloy loaded with particles of one or more metals or alloys such as platinum group metals or platinum group metal alloys, silver and gold.

By a platinum group metal in this specification is meant one of the platinum group metals Ru, Rh, Pd, Ir and Pt.

Suitable insulating materials that may be used are refractory oxides, such as silica, titania, zirconia and alumina; ceramics and glasses; carbides, borides, nitrides, silicides and similar materials. A preferred nitride is silica nitride $Si_3N_4$.

An igniter electrode or at least the working surface thereof needs to have good mechanical strength at high temperatures and corrosion (including oxidation) and creep resistance. Materials which exhibit these properties and which are frequently used in the jet aero-engine and gas turbine industries are the superalloys previously referred to.

In the case of nickel-based superalloys, the high hot strength is obtained partly by solid solution hardening using such elements as tungsten or molybdenum and partly by precipitation hardening. The precipitates are produced by adding aluminium and titanium to form the intermetallic $Ni_3(TiAl)$. Stable metal carbides are also intentionally formed in some instances to improve the strength still further.

Igniter electrodes according to the present invention may be formed:

i. by a. cladding or coating an electrode body, made of a base metal or alloy, with one or more metals selected from the group consisting of Ru, Rh, Pd, Ir, Pt, Ag and Au, or b. bringing the said electrode body into contact with particles of one or more metals selected from the group consisting of Ru, Rh, Pd, Ir, Pt, Ag and Au and then causing metal from the said cladding or coating or from the said particles to diffuse into the said body.

The electrode body may typically be of tunsten or tungsten alloy or of a Nimonic alloy or of Inconel or of a superalloy and diffusion may conveniently be accomplished by heating the coated or clad electrode body or the assembly of the electrode body and the particles.

When preparing an electrode in accordance with section (i) (a) above, the coating may be applied by electroplating. A suitable method of cladding, on the other hand, is described in U.S. Pat. No. 3,478,415 (Selman);

ii. by forming the entire electrode or a part thereof from a nickel- and/or cobalt-based alloy, especially a superalloy which also contains one or more metals selected from the group consisting of Ru, Rh, Pd, Ir, Pt, Ag and Au. Such alloys preferably contain from 5 to 15 wt.% platinum and are described in co-pending U.S. application Ser. No. 593,250; or iii. by forming the entire electrode or a part thereof from a composite material containing one or more metals selected from the group consisting of Ru, Rh, Pd, Ir, Pt, Ag and Au and one or more base metals or compounds thereof. The composite material may comprise a skeletal structure formed of bonded particles of one or more of the metals Ru, Rh, Pd, Ir, Pt, Ag and Au and alloys thereof, the said structure having been infiltrated with one or more metals or alloys such as Ag/Pd alloy or a Cu/Ni alloy. Alternatively, the composite material may comprise a metal or alloy loaded with particles of one or more metals selected from the group consisting of Ru, Rh, Pd, Ir, Pt, Ag and Au and alloys thereof. Such a material might, for instance, comprise Ag/Pd alloy loaded with particles of platinum. Yet again, the composite material may be dispersion strengthened metals or alloys selected from the group consisting of Ru, Rh, Pd, Ir, Pt, Ag, Au and alloys thereof. Methods of manufacturing such dispersion strengthened alloys are described in British Pat. Specifications Nos. 1,280,815 and 1,340,076 and U.S. Pat. Specification Nos. 3,689,987, 3,696,502 and 3,709,667.

Igniters according to the present invention are particularly suitable for continuous operation and are therefore well adapted for use in aircraft such as military and test aircraft, helicopters and VTOL aircraft and in certain passenger aircraft where flying conditions necessitate the continuous use of igniters.

What we claim is:

1. An igniter comprising two or more electrodes separated by a body of insulating or semi-conducting material and having exposed working surfaces between which sparks may pass, at least part of the working surface or surfaces of at least one of the electrodes comprising a host material in which Co or Ni predominates alloyed or compounded with one or more additional metals selected from the group consisting of Ru, Rh, Ir, Pt, Ag and Au.

2. An igniter according to claim 1, wherein the additional metal or metals constitute from a trace to 20 wt.% of the total metal content.

3. An igniter according to claim 1, wherein the most material is an alloy comprising 20 wt.% Cr, 0.4 wt.% Ti, 0.1 wt.% Mn, 0.7 wt.% Si, 0.01 wt.% C and balance nickel and wherein from a trace to 20 wt.% of the nickel content is replaced by one or more of the additional metals.

4. An igniter according to claim 3, wherein the additional metal is Pt.

5. An igniter according to claim 4, wherein Pt is present in an amount from a trace to 10 wt.% of the total metal content.

6. An igniter according to claim 1, wherein the host material is an alloy comprising 9.0 wt.% Cr, 10 wt.% Co, 12 wt.% W, 1.0 wt.% Nb, 5.0 wt.% Al, 2.0 wt.% Ti, 0.15 wt.% C, 0.015 wt.% B, 0.05 wt.% Zr and balance nickel, and wherein from a trace to 20 wt.% of the nickel is replaced by one or more of the additional metals.

7. An igniter according to claim 6, wherein the additional metal is Pt.

8. An igniter according to claim 7, wherein Pt is present in an amount from a trace to 10 wt.% of the total metal content.

9. An igniter according to claim 1, wherein the host material is an alloy comprising 40 to 98 wt.% nickel and a trace to 30 wt.% chromium and wherein the additional metal or metals constitute from a trace to 15 wt.% of the total metal content.

10. An igniter according to claim 9, wherein the host material contains from 54 to 78 wt.% Ni and from 13 to 25 wt.% Cr and wherein the additional metal or metals constitute from 5 to 15 wt.% of the total metal content.

11. An igniter according to claim 9, wherein the host material contains at least 40 wt.% Ni and from a trace to the percentage specified of any one or more of the following components:

| | | |
|---|---|---|
| cobalt | 25 | wt.% |
| titanium | 6 | wt.% |
| aluminium | 7 | wt. |
| tungsten | 20 | wt.% |
| molybdenum | 20 | wt.% |
| hafnium | 2 | wt.% |
| manganese | 2 | wt.% |
| silicon | 1.5 | wt.% |
| vanadium | 2.0 | wt.% |
| niobium | 5 | wt.% |
| boron | 0.15 | wt.% |
| carbon | 0.05 | wt.% |
| tantalum | 10 | wt.% |
| zirconium | 3 | wt.% |
| iron | 20 | wt.% |
| thorium/rare earth metals or oxides thereof | 3 | wt.%. |

12. An igniter according to claim 11, wherein the additional metal is platinum present in an amount from a trace to 15 wt.% of the total metal content.

13. An igniter according to claim 10, wherein the host material contains at least 40 wt.% Ni and from a trace to the percentage specified of any one or more of the following components:

| | | |
|---|---|---|
| cobalt | 25 | wt.% |
| titanium | 6 | wt.% |
| aluminum | 7 | wt.% |

-continued

| | | |
|---|---|---|
| tungsten | 20 | wt.% |
| molybdenum | 20 | wt.% |
| hafnium | 2 | wt.% |
| manganese | 2 | wt.% |
| silicon | 1.5 | wt.% |
| vanadium | 2.0 | wt.% |
| niobium | 5 | wt.% |
| boron | 0.15 | wt.% |
| carbon | 0.05 | wt.% |
| tantalum | 10 | wt.% |
| zirconium | 3 | wt.% |
| iron | 20 | wt.% |
| thorium/rare earth metals or oxides thereof | 3 | wt.%. |

14. An igniter according to claim 13, wherein the additional metal is platinum present in an amount from a trace to 15 wt.% of the total metal content.

15. An igniter according to claim 1, wherein the host material is an alloy comprising not less than 40 wt.% Co and a trace up to 30 wt.% chromium and wherein the additional metal or metals constitute from a trace to 15 wt.% of the total metal content.

16. An igniter according to claim 15, wherein the additional metal is platinum present in an amount from a trace to 15 wt.% of the total metal content.

17. An igniter according to claim 15, wherein the host material contains not less than 40 wt.% Co and from 13 to 25 wt.% chromium, and wherein the additional metal or metals constitute from 5 to 15 wt.% of the total metal content.

18. An igniter according to claim 17, wherein the additional metal is platinum present in an amount from a trace to 15 wt.% of the total metal content.

19. An igniter according to claim 17, wherein the most material contains at least 40 wt.% cobalt and from a trace to the percentage specified of any one or more of the following components:

| | | |
|---|---|---|
| nickel | 25 | wt.% |
| titanium | 2 | wt.% |
| aluminium | 5 | wt. |
| tungsten | 30 | wt.% |
| molybdenum | 5 | wt.% |
| iron | 5 | wt.% |
| tantalum | 10 | wt.% |
| niobium | 5 | wt.% |
| manganese | 2 | wt.% |
| silicon | 1 | wt.% |
| carbon | 1 | wt.% |
| boron | 0.05 | wt.% |
| zirconium | 1.5 | wt.% |
| rhenium | 3 | wt.% |
| thorium/rare earth metals or oxides thereof | 5 | wt.%. |

20. An igniter according to claim 19, wherein the additional metal is platinum present in an amount from a trace to 15 wt.% of the total metal content.

21. An igniter according to claim 1, wherein the said additional metal or metals constitute a surface layer on a substrate constituted by the host material.

22. An igniter according to claim 21, wherein the surface layer is diffusion bonded to the substrate of the host material.

23. An igniter according to claim 1, wherein the insulating or semi-conducting material is selected from the group consisting of refractory oxides, ceramics, glasses, carbides, borides, nitrides and silicides.

24. An igniter comprising two or more electrodes separated by a body of insulating or semi-conducting material and having exposed working surfaces between which sparks may pass, at least part of the working surface of an electrode comprising a dispersion-strengthened platinum group metal or platinum group metal alloy; thoriated tungsten platinum; a cermet; a composite material comprising a skeleton of sintered platinum group metal particles, Ag or Au into which is infiltrated a Cu/Ni alloy; or an Ag/Pt alloy loaded with particles of one or more platinum group metals, platinum group metal alloys, silver or gold.

* * * * *

UNITED STATES PATENT OFFICE

CERTIFICATE OF CORRECTION

Patent No. 4,081,710 Dated March 28, 1978

Inventor(s) Alan Edward HEYWOOD and Robert Michael HUTCHINGS

It is certified that error appears in the above-identified patent and that said Letters Patent are hereby corrected as shown below:

Claim 1, at column 5, line 1, after

"Rh," insert --Pd,--

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*